US007430866B1

(12) United States Patent
Lynch et al.

(10) Patent No.: US 7,430,866 B1
(45) Date of Patent: Oct. 7, 2008

(54) AIR-INDEPENDENT FUEL COMBUSTION ENERGY CONVERSION

(75) Inventors: William A. Lynch, Philadelphia, PA (US); Neal A. Sondergaard, Severna Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 280 days.

(21) Appl. No.: 11/272,424

(22) Filed: Nov. 8, 2005

(51) Int. Cl.
*F01K 13/00* (2006.01)

(52) U.S. Cl. ..... 60/645; 60/670

(58) Field of Classification Search ..... 60/645, 60/670, 682

See application file for complete search history.

(56) References Cited

U.S. PATENT DOCUMENTS 3,122,429 A * 2/1964 Toulmin, Jr. ..... 149/1
3,304,205 A * 2/1967 Lord et al. ..... 136/208
3,969,891 A * 7/1976 Aguet ..... 60/39.182
4,029,035 A * 6/1977 German ..... 114/67 A
5,007,973 A * 4/1991 Trapp et al. ..... 149/109.6
5,356,487 A * 10/1994 Goldstein et al. ..... 136/253
7,275,644 B2 * 10/2007 Ness et al. ..... 209/474

* cited by examiner

*Primary Examiner*—Hoang M Nguyen
(74) *Attorney, Agent, or Firm*—Jacob Shuster

(57) ABSTRACT

A metallic fuel mixture including solidic powders such as silicon, aluminum and magnesium together with an oxidant, and steam and hydrogen are fed into a combustor to undergo combustion therein. The combustor is positioned within a steam chamber enclosure filled with water as working fluid which is heated by the combustion. The heated water within the stream chamber enclosure is thereby converted into pressurized steam fed into a turbine for operation thereof to impart rotation to a shaft thereby propelling a sea vessel within which the steam chamber enclosure is housed. During such combustion, discharge from the combustor of a liquid by-product occurs as outflow through an exhaust funnel into a collector from which the by-product is processed for ejection into seawater without signature detection. The radiant energy generated by such combustion may be converted by photovoltaic cells within the steam chamber enclosure into electrical energy made available outside of the steam chamber enclosure, while some of the heat energy generated by the combustion within the combustor may also be converted by thermoelectric cells into electrical energy made available outside of the steam chamber enclosure.

4 Claims, 2 Drawing Sheets

AIR-INDEPENDENT FUEL COMBUSTION ENERGY CONVERSION

The present invention relates generally to combustion of fuel for generating propulsion energy within a seawater environment.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

Air-independent fuel combustion systems for generating energy to propel a sea vessel within a seawater environment requires use of an oxidant within a combustor. Additionally an internal combustion engine and turbine associated with the combustor generally require an excessive supply of oxygen extracted from the oxidant for operational support. Furthermore, the combustion product discharged from the combustor, such as carbon dioxide ($CO_2$), may result in expulsion of a detectable signature from the seawater vessel being propelled.

Aluminum and magnesium powders form solidic powder mixtures utilized as combustible fuel with either air or water as oxidants. The aluminum type fuel mixture advantageously provides an excellent energy density as a result of the combustion. However, its associated combustion discharge by-product may form a slag responsible for agglomerating and clogging problems with respect to the exhaust port of the combustor. The magnesium type of fuel mixture is advantageously more readily combustible under a lower boiling point than the aluminum type but provides for a significantly lower energy density. It is therefore an important object of the present invention to utilize both of the advantages associated with aluminum and magnesium fuel mixtures while avoiding the latter referred to problems associated therewith in air-independent combustion systems.

SUMMARY OF THE INVENTION

Pursuant to the present invention, both aluminum (Al) and magnesium (Mg) are utilized to form with silicon (Si) an alloy such as $Mg_2Al_4Si_5$ or a similar compound of a fuel mixture fed into a combustor with an oxidant. The combustor is enclosed within a steam chamber into which a working fluid such as water is injected. Combustion of the fuel mixture is initiated within the combustion chamber in response to inflow of steam or some other suitable oxidant so as to generate heat therein which elevates the temperature of the working fluid water to thereby supply pressurized steam into a turbine from which mechanical energy is rotationally delivered for propulsion of a sea vessel within seawater.

The combustor is connected by a funnel extending from the combustion chamber to a collector within which a liquid combustion by-product such as a eutectic cordierite oxide ($Mg_2Al_4Si_5O_{18}$) is received as a result of the combustion of the fuel mixture. Such by-product oxide has a significantly lower melting point than other metal oxides. Under selective control, the liquid combustion by-product is solidified, cooled, and discharged from the collector, without signature detectability, into the seawater environment of the sea vessel without contamination thereof. The type of combustion discharge from the turbine also avoids signature detection.

The outer shell of the steam chamber of the combustor serves as a pressure vessel containing steam and may have mounted thereon photo-voltaic cells through which radiant energy generated by the combustion is converted into electrical energy. Thermoelectric cells may also be mounted within a layered wall of the combustion chamber inside the stream chamber for consuming some of the combustion generated heat by conversion into electrical energy. A heat shield would protect the cells and/or chamber wall from excess heat imposed by direct contact with the flame or abrasive damage associated with the combustion products. The electrical energy respectively converted by the photovoltaic and the thermoelectric cells is delivered therefrom for use outside the steam chamber.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF THE PREFERRED EMBODIMENT

Figure 1:
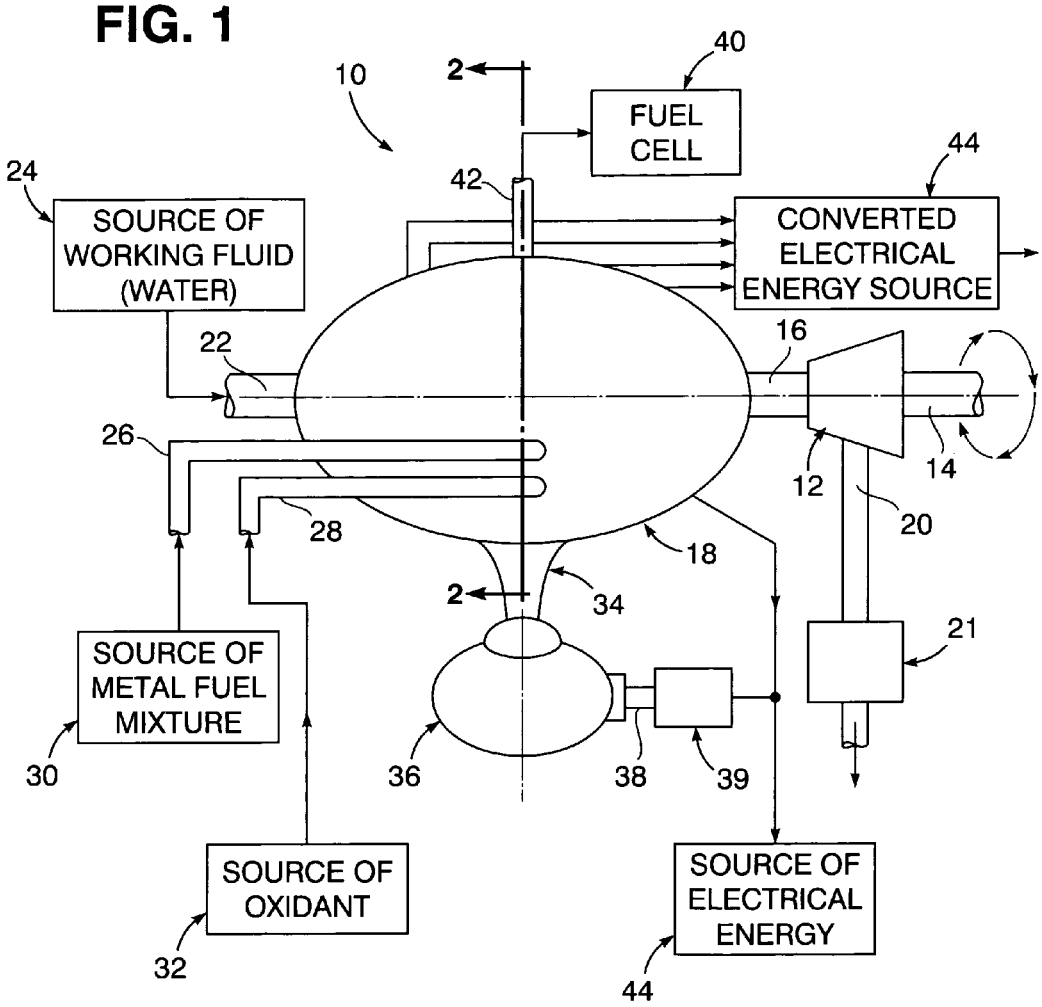
FIG. 1 is a side elevation view of the components associated with a fuel combustion energy conversion system pursuant to the present invention, with certain other facilities associated therewith diagrammatically illustrated.

Referring now to the drawing in detail, FIG. 1 illustrates an air-independent type of fuel combustion energy conversion system 10 through which sea vessel vehicles may be propelled within a seawater environment. Accordingly, the system 10 has a power turbine 12 associated therewith from which a propulsion drive shaft 14 extends to mechanically impart rotational energy to propellers of a propulsion unit, associated with the sea vessel for example. The rotational energy output of the turbine 12 to the shaft 14 is derived from pressurized steam delivered through a steam line 16 from a steam chamber enclosure 18. Low pressure steam is then discharged from the turbine 12 through an exhaust line 20 into a condenser 21 as a result of combustion within the chamber enclosure 18. The pressurized steam supplied to the turbine 12 from the chamber enclosure 18 is derived from a working fluid, such as water, fed into the chamber enclosure 18 through a working fluid infeed line 22 from a source 24 as diagrammed in FIG. 1. The working fluid or water received through the infeed line 22 within the chamber enclosure 18 is converted into pressurized steam which is fed into the turbine 12 through the steam line 16, while fuel mixture is supplied to the chamber enclosure 18 through a fuel infeed line 26 from a source 30 of a metal fuel mixture together with an oxidant, such as steam, through an infeed line 28 from a source of oxidant 32 as diagrammed in FIG. 1. As a result of the combustion within the chamber enclosure 18, a byproduct such as eutectic mineral cordierite liquid oxide mixture by-product is formed having a lower melting point of 1467° C., relative to that of other metal oxides, which is discharged from the chamber enclosure 18 through a by-product exhaust funnel 34 into a by-product collector 36. The by-product liquid collected within the collector 36 may be discharged therefrom under selective control through a by-product discharge line 38. A processor 39 cools the by-product in the discharge line 38 and converts it into a dischargeable form. The combustion by-product mixture delivered from the chamber enclosure 18 is thereby cooled and solidified into a convenient form such as spheres, pellets or granular particles similar to sand by way of example. Steam and hydrogen formed as by-products of combustion also exit from the chamber enclosure 18 through a by-product output line 42 into a fuel cell 40 as diagrammed in FIG. 1, which also diagrams the possible delivery from the chamber enclosure 18 of converted electrical energy from the processor 39 outside of the system 10 to an electrical energy storage device 44. The hydrogen by-product may be optionally utilized within the fuel cell 40 if oxygen or a suitable oxidant is available.

Figure 2:
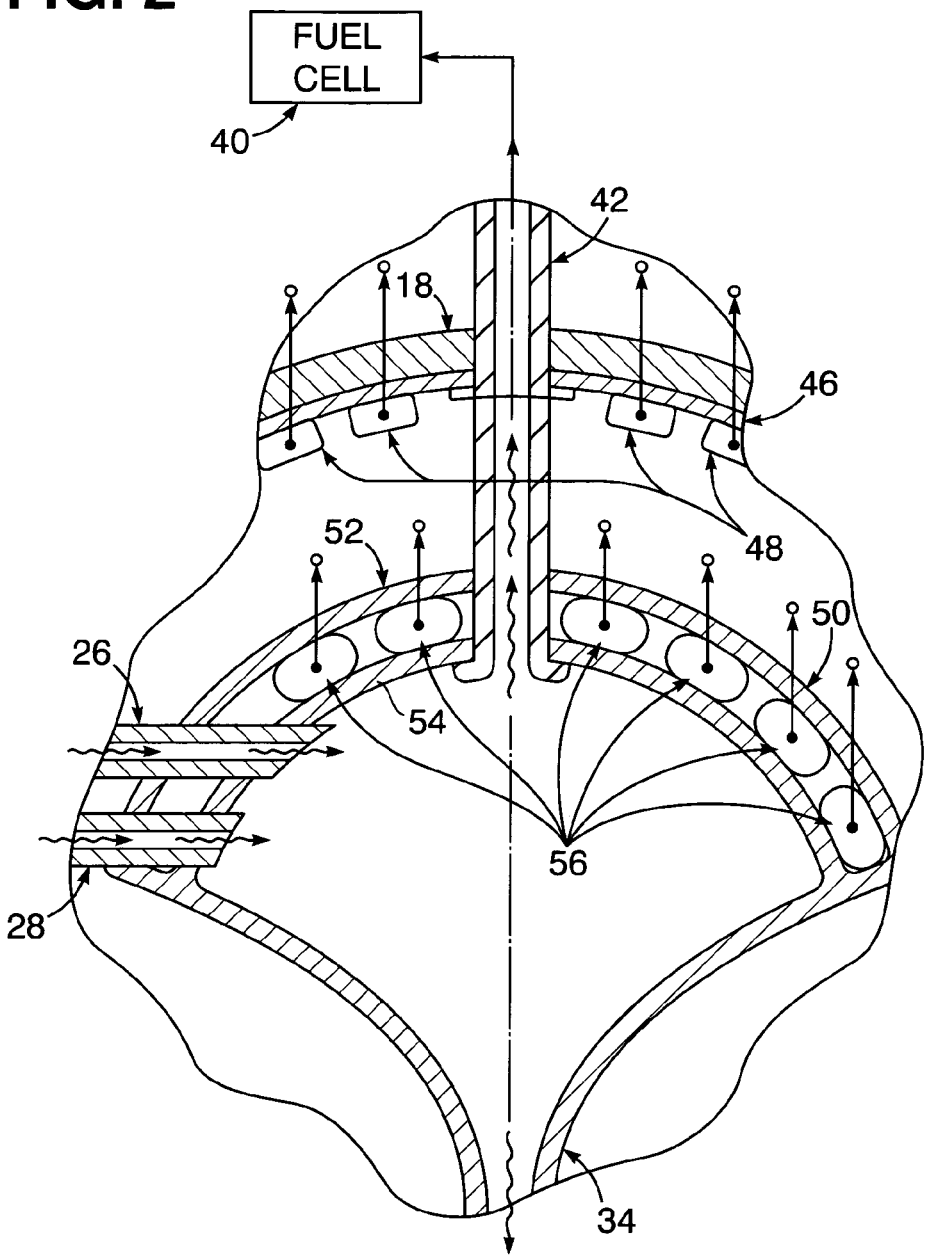
FIG. 2 is a partial section view taken substantially through a plane indicated by section line 2-2 in FIG. 1.

As shown in FIG. 2, the outer shell of the steam chamber enclosure 18 is internally coated with an electrically insulating protective lining such as silicon rubber 46 to prevent chamber shell corrosion under high pressure hot temperature steam conditions within the steam chamber enclosure 18 and to electrically isolate an optional radiant energy collector such as a photovoltaic array. A plurality of photovoltaic cells 48 may be internally mounted on the internally coated outer shell of the steam chamber enclosure 18 so as to convert radiant energy produced therein by the combustion directly into electrical energy delivered for use outside of the system 10 from the energy storage 44 as diagrammed in FIG. 1. The cells 48 are likely to be a special type similar to those used in sun concentration systems. The insulation lining 46 also serves as an adhesive for attachment of the solar cells 48.

As also shown in FIG. 2, a fuel combustor 50 connected to the funnel 34 is positioned within the steam chamber enclosure 18, to which the fuel infeed line 26, the oxidant infeed line 28 and the by-product output line 42 are connected. The fuel and oxidant when conducted respectively through the fuel infeed line 26 and the oxidant infeed 28 into the fuel combustor 50 results in the high temperature radiant energy emitting combustion being performed therein producing the aforementioned by-product discharge therefrom through the funnel 34 and the by-product outflow line 42. The heat generated by such combustion elevates the temperature of the working fluid within the steam chamber enclosure 18 for pressurized heating of the working fluid water therein into the steam fed through the steam line 16 into the turbine 12.

With continued reference to FIG. 2, the combustor 50 is of a double wall outer shell type having an outer shell layer 52 spaced from an inner shell layer 54. Thermoelectric cells 56 are sandwiched between the combustor shell layers 52 and 54 so as to convert some of the combustion heat directly into some of the electrical energy made available for consumption outside of the system 10 from the storage 44. The inner layer 54 is composed of a refractory material such as rhenium or tungsten, which serves as a heat shield. Such consumption of some of the heat energy generated by combustion within the combustor 50 accordingly lowers the temperature and pressure of the steam within the steam chamber enclosure 18 for more practical operation of the turbine 12.

According to one embodiment of the present invention, the fuel mixture fed into the system 10 from the source 30 through the infeed line 26 is a metal alloy such as pre-cordierite that consists of a mixture of silicon, aluminum and magnesium having a formula such as: $Mg_2Al_4Si_5$. The combustion by-product resulting from the combustion thereof has a significantly lower melting point of 1467° C. as compared to 1715° C., 2054° C., and 2826° C. respectively associated with combustion by-product of silicon (Si), aluminum (Al) and magnesium (Mg) components of the fuel mixture delivered from the source 30. Operation of the combustor 50 thereby results in discharge of a mineral cordierite combustion by-product from the chamber enclosure 18 through the funnel 34 as a liquid rather than a solid, with the aforementioned low melting point temperature so as to eliminate any slag agglomeration problem by initial handling of the by-product as a liquid. Furthermore, the aforementioned discharged by-product is of a composition similar to that of the basalt oceanic crust in the seawater environment so as to avoid discharge of a detectable signature having an environmental impact.

According to another embodiment of the present invention, the aforementioned fuel mixture from the source 30 is replaced by a wire type of fuel that is relatively safe to handle and store, such as a thin-walled aluminum tube containing a mixture of silicon magnesium and possibly other additives stored on a spool. The latter referred to type of fuel is delivered to a port on the combustor 50 inside of the chamber enclosure 18 using a servo-mechanism such as that utilized with a welding device.

Obviously, other modifications and variations of the present invention may be possible in light of the foregoing teachings. It is therefore to be understood that within the scope of the appended claims the invention may be practiced otherwise than as specifically described.

What is claimed is:

1. An energy conversion system comprising:

a steam chamber for sustaining a combustion reaction therein;

a supply of working fluid for said combustion reaction;

a working fluid infeed line attached to the supply of working fluid and attached to the steam chamber for supplying the working fluid to the steam chamber;

a supply of oxidant for said combustion reaction;

an oxidant infeed line attached to the supply of oxidant and attached to the steam chamber for supplying the oxidant to the steam chamber;

a supply of $Mg_2Al_4Si_5$ for fuel in said combustion reaction;

a fuel infeed line attached to the supply of $Mg_2Al_4Si_5$ and attached to the steam chamber for supplying the $Mg_2Al_4Si_5$ to the steam chamber;

a steam line attached to the steam chamber for directing steam generated by said combustion reaction, away from the steam chamber; and a turbine attached to the steam line for converting steam heat generated by said combustion reaction into mechanical energy.

2. The energy conversion system of claim 1, further comprising:

an exhaust funnel connected to the steam chamber for receiving $Mg_2Al_4Si_5O_{18}$ generated as a byproduct of said combustion reaction;

a collector connected to the exhaust funnel, wherein the $Mg_2Al_4Si_5O_{18}$ byproduct is directed into the collector via the exhaust funnel.

3. The energy conversion system of claim 2, further comprising:

photovoltaic cells mounted within the steam chamber for converting radiant energy generated by said combustion reaction into electrical energy.

4. The energy conversion system of claim 2, further comprising:

thermoelectric cells mounted within the steam chamber for converting heat energy generated by said combustion reaction into electrical energy.

* * * * *